US005398633A

United States Patent [19]

Loverich et al.

[11] Patent Number: 5,398,633

[45] Date of Patent: Mar. 21, 1995

[54] TAUTLINE BOAT MOORING SYSTEM

[75] Inventors: Gary F. Loverich, Bainbridge Island; Robert J. Mennucci, Bainbridge, both of Wash.

[73] Assignee: Nor'Eastern Trawl Systems, Inc., Bainbridge Island, Wash.

[21] Appl. No.: 198,185

[22] Filed: Feb. 17, 1994

[51] Int. Cl.[6] ..... B63B 21/00

[52] U.S. Cl. ..... 114/230; 114/293

[58] Field of Search ..... 405/63, 66, 60, 70, 405/72, 219; 114/230, 293, 263, 241, 240 E; 441/3, 23, 28, 21, 1, 4, 5

[56] References Cited

U.S. PATENT DOCUMENTS

| | | | |
|---|---|---|---|
| 1,292,755 | 1/1919 | Geraghty | 114/241 |
| 3,138,135 | 6/1964 | Langer | 114/230 |
| 3,703,151 | 11/1972 | Clement | 114/230 |
| 4,174,186 | 11/1979 | Kasai et al. | 405/63 |
| 4,248,547 | 2/1981 | Brown | 405/72 |
| 5,007,376 | 4/1991 | Loverich et al. | 119/3 |
| 5,107,784 | 4/1992 | Lacy | 114/293 |
| 5,193,481 | 3/1993 | Loverich et al. | 119/3 |

FOREIGN PATENT DOCUMENTS

| | | | |
|---|---|---|---|
| 51-10665 | 8/1977 | Japan . | |
| 989981 | 4/1965 | United Kingdom | 441/3 |

*Primary Examiner*—Edwin L. Swinehart

[57] ABSTRACT

A mooring system for mooring boats (20). The mooring system (10) includes elongated spar buoys (12, 13), tautlines (16), a gridline (14), and anchor assemblies (18). The spar buoys (12, 13) float vertically at spaced-apart locations and are interconnected by the tautlines (16) and the gridline (14), the tautlines (16) being connected to the tops of the spar buoys (12, 13), and the gridline (14) being connected to the bottoms of the spar buoys (12, 13). The anchor assemblies (18) are attached to selected spar buoys (12) and urge the spar buoys (12, 13) apart and maintain the tautlines (16) and the gridline (14) in a taut condition. The tautlines (16) are positioned above and parallel to the water surface (22) so that boats (20) can tie up along the length of the tautlines (16).

22 Claims, 8 Drawing Sheets

TAUTLINE BOAT MOORING SYSTEM

FIELD OF THE INVENTION

This invention generally relates to systems for mooring boats and, more particularly, to systems for mooring boats in a predefined configuration.

BACKGROUND OF THE INVENTION

In the past, three types of systems have been used to moor boats. One common mooring system comprises floating docks that are held in place by anchors and/or piles. A boat is moored by tying the length of the boat alongside a section of the floating docks. There are, however, several problems associated with floating dock mooring systems. First, floating docks are generally sensitive to waves and over time tend to warp and break apart from continuous exposure to waves, particularly if the docks are made of wood. Floating docks can also be damaged by minor collisions with boats, and, in sub-freezing climates, floating docks can be damaged when the water surface freezes over. Furthermore, such docks are generally large structures so that it is difficult to install and remove the docks. If the docks are held in place with piles driven into the bottom (sea bed), the configuration of the docks is normally difficult to change without altering the piling configuration. Furthermore, floating dock mooring systems are relatively expensive and can be unsightly in appearance.

Another common mooring system consists of individual mooring buoys, held in place by anchors and anchor lines. A boat may be tied at its bow to a single buoy, or its bow may be tied to one buoy and its stern tied to a second buoy that is spaced apart from the first. While mooring systems using buoys overcome many of the problems of floating dock systems, the use of mooring buoys has other drawbacks. If the configuration employing a single buoy per boat is used, the boat will swing freely around the buoy unless the stern of the boat is anchored with an onboard anchor, which is generally time consuming to drop and properly set. Whether the stern of the boat is allowed to swing about or is secured by dropping an anchor, the position of the boat with respect to the buoy is unpredictable, i.e., the boat can be positioned radially anywhere around the buoy. As a result, such mooring buoys must be separated from other buoys by a significant distance so that moored boats will not collide. Accordingly, the maximum safe mooring density for such a configuration is relatively low. A similar problem exists with respect to a bow and stern buoy configuration because the buoys must be spaced apart sufficiently to accommodate a maximum acceptable boat length.

A third system for mooring boats simply relies on boats dropping and setting onboard bow and/or stern anchors. The problem with the self-anchored mooring system is that the positioning of boats is not controlled and the maximum achievable safe mooring density is very low. Furthermore, it is omen inconvenient and time consuming for boats to moor by dropping onboard anchors.

What is needed is a high density mooring system that: can withstand collisions with boats, continuous wave disturbances, and ice; and, can accommodate boats of widely varying lengths; is low in cost; is not unsightly; and is easily installed, reconfigured, and removed. As described more fully below, the present invention provides a mooring system that meets these criteria and overcomes the aforementioned problems in the prior art.

SUMMARY OF THE INVENTION

In accordance with this invention, a boat mooring system is provided for mooring boats in a predefined configuration. In one preferred embodiment, the mooring system includes at least two elongated spar buoys, a tautline, a gridline, and at least two anchor assemblies. The elongated spar buoys are adapted to float vertically in a body of water and are interconnected at spaced-apart locations by the tautline and gridline. The gridline interconnects the bottoms of the spar buoys well beneath the water surface, and the tautline interconnects the tops of the spar buoys above the water surface. The anchor assemblies are attached to selected spar buoys and are disposed so as to urge the spar buoys away from each other and maintain the tautline and gridline in a taut condition. A boat moors by tying up alongside a section of the tautline. Preferably, tie-offs are placed at several spaced-apart points along the tautline so that a boat can be easily moored by securing lines between the boat and selected tie-offs.

In accordance with further aspects of the invention, the spar buoys and tautline are preferably arranged in an open configuration so that boats can tie up alongside either side of the tautline. In one preferred embodiment, the spar buoys and tautline are linearly arranged. In one preferred linear arrangement, two end spar buoys are used and at least one intermediate spar buoy is positioned at an intermediate point between the end spar buoys. In this preferred linear arrangement, anchor assemblies are attached to the end spar buoys to urge the end spar buoys apart and, together with the tautline and gridline, prevent the end spar buoys from moving horizontally. Anchor assemblies can also be attached to the intermediate spar buoy so as to prevent it from moving in a direction transverse to the tautline.

In accordance with still further aspects of the invention, a second tautline is attached to the spar buoys adjacent and parallel to the other tautline. In one preferred embodiment, a cross-tree is formed at the tops of the spar buoys for securing the tautlines on opposite sides of the spar buoys. When the spar buoys and gridline are arranged in an open configuration, boats can tie up along opposite sides of the mooring system using the respective tautlines disposed on the opposite sides.

In accordance with still further aspects of the invention, in one preferred embodiment, an anchor assembly comprises an anchor, an anchor line that attaches the anchor to a spar buoy, and a tom weight attached to the anchor line at a position between the spar buoy and anchor. When the mooring system is installed, the tom weight is suspended above the bottom (sea bed) and exerts a vertical gravitational force on the anchor line so as to keep the anchor line taut. In accordance with still further aspects of the invention, a ballast is attached to the bottom of each spar buoy so that the spar buoy's center of gravity is below its center of buoyancy, enabling the spar buoy to float vertically.

Another aspect of the present invention is directed to a method for providing a boat mooring system. This method comprises the steps of floating a plurality of spar buoys in a body of water, interconnecting upper portions of the spar buoys with a tautline, interconnecting lower portions of the spar buoys with a gridline, and anchoring the selected spar buoys so that the spar buoys are held in a particular area in the water and the tautline is above the water surface in a taut condition.

As will be appreciated from the foregoing brief summary, a mooring system for mooring boats in a predefined configuration is provided. The mooring system can withstand severe and continuous waves and currents because the mooring system does not include a rigid structural frame. For this same reason, the mooring system is not easily damaged by ice or by boats colliding with the mooring system. The mooring system is able to accommodate various boat lengths because a boat can tie up along any portion of a tautline of the mooring system positioned near the water surface, and other boats can tie up to other unoccupied sections of the tautline. It will be further appreciated that only the tops of the spar buoys and the tautlines are visible above the water surface, so that the mooring system is not unsightly. As will be further appreciated, the mooring system can be easily configured in various shapes, such as in an "L" or "E" shape or as a series of generally parallel and spaced-apart sections, by selecting an appropriate number of spar buoys, appropriate tautline and gridline lengths, and appropriately positioning the anchor assemblies. Furthermore, even after being installed, the mooring system can be easily reconfigured or removed. Finally, it will be appreciated that the mooring system is relatively inexpensive.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
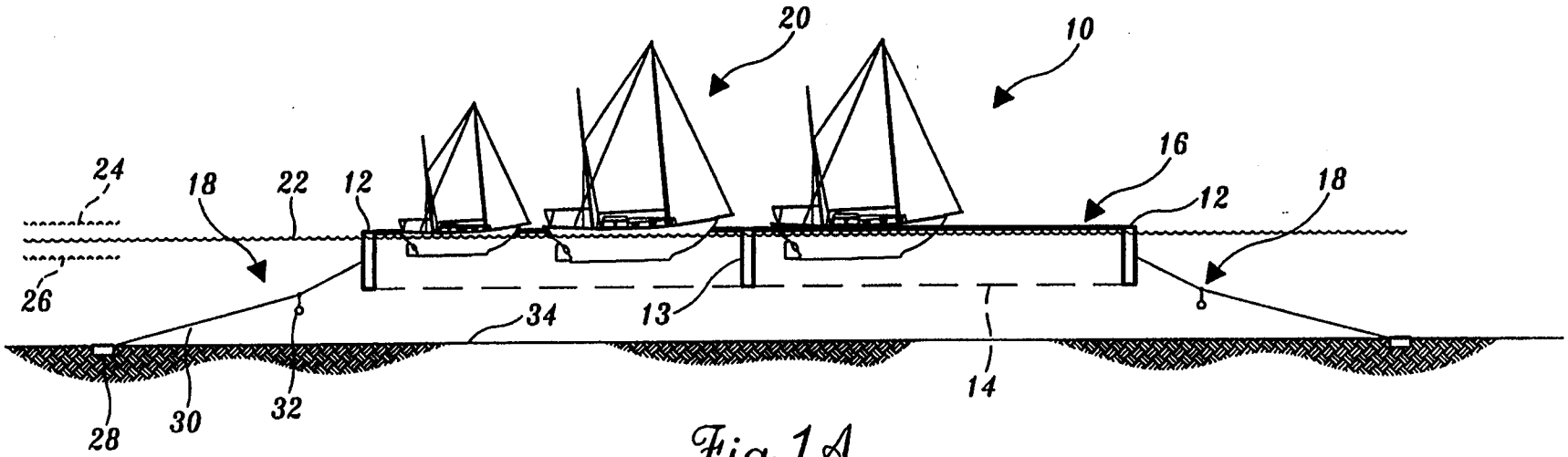
FIGS. 1A and 1B are respectively a side view and a top view of one preferred configuration of the tautline boat mooring system according to the present invention.
Figure 1B:
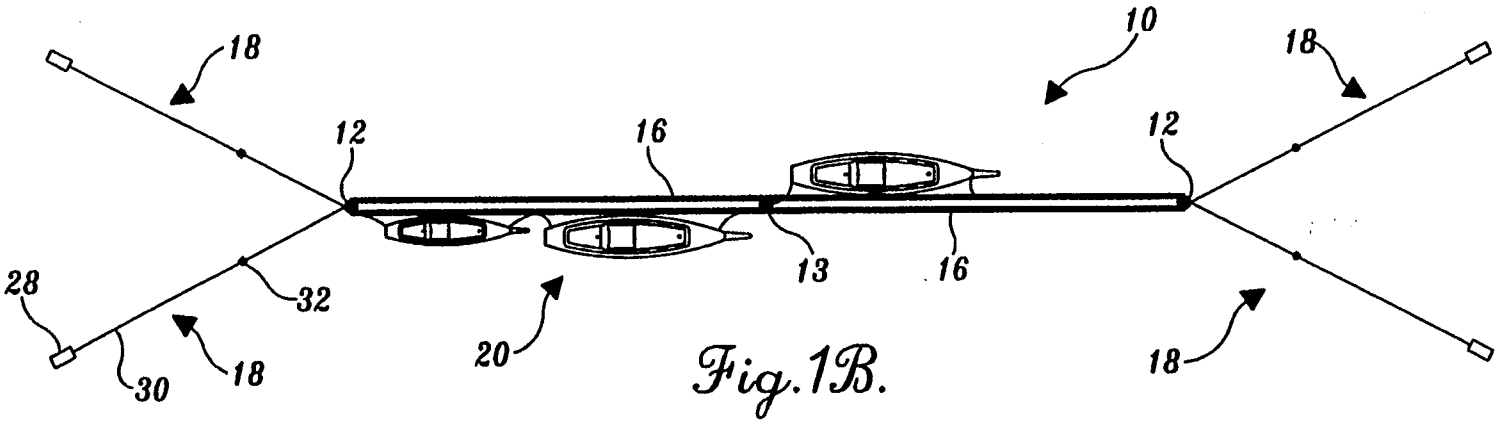

FIGS. 1A and 1B illustrate one preferred configuration of the tautline boat mooring system 10 provided by the present invention; in particular, a simple linear configuration is shown. As seen in the side view of FIG. 1A, the boat mooring system 10 includes spar buoys 12, 13, a gridline 14, tautlines 16, and anchor assemblies 18. In the particular preferred configuration shown, the mooring system 10 includes two end spar buoys 12 and an intermediate spar buoy 13, though it is to be understood that additional intermediate spar buoys 13 could be included. The bottoms of the end spar buoys 12 and the intermediate spar buoy 13 are interconnected by the gridline 14 and the tops of the spar buoys 12, 13 are interconnected by the tautlines 16. As seen in the top view of FIG. 1B, the spar buoys 12, 13 and tautlines 16 are configured linearly, with the intermediate spar buoy 13 located on a substantially geometrically straight line between the end spar buoys 12. The anchor assemblies 18 are attached to the end spar buoys 12, extending downwardly to the bottom and beyond the end spar buoys 12 so as to urge the end spar buoys 12 away from each other. The tautlines 16 and gridline 14 are maintained in a taut condition by the anchor assemblies 18, even if the water surface 22 changes between a high tide 24 and a low tide 26.

As can be seen in FIG. 1B, the tautlines 16 are attached to opposite sides of the spar buoys 12, 13, so that boats 20 can be moored along either side of the mooring system 10 by tying up to either of the tautlines 16. Because a boat can tie up at any free section along one of the tautlines 16, the mooring system 10 can accommodate boats of various lengths. Furthermore, two boats can tie up adjacent to one another, by tying up to opposite sides of the mooring system 10, i.e., to opposite tautlines 16.

The boat mooring system 10 does not include a rigid structural frame, and as a result, the system is able to withstand severe waves and current, as well as ice and boats colliding with the mooring system. The spar buoys 12, 13 are elongated, e.g., cylindrical, and adapted to float vertically, as seen in FIG. 1A. The buoyancy of the spar buoys 12, 13 is preferably adjusted such that the tops of the spar buoys are above the water surface 22, thereby ensuring that the tautlines 16 are exposed above the water surface to allow a boat to easily tie up to one of the tautlines. The spar buoys are preferably sufficiently long so that the bottom of the spar buoys, and therefore the attached gridline 14, are positioned at a depth in the water below the draft of boats 20 with which the mooring system is intended to be used. Preferably, the water plane area of each spar buoy (i.e., the area of the cross section of the spar buoy cut by the water surface) is small relative to the mass of the spar buoy, so that the spar buoys remain relatively stationary even when there are minor wave disturbances on the water surface. As a result, the tautlines do not readily move with surface waves, as would be the case if the spar buoys were designed with a relatively large water plane area. This relative stability of the elongated spar buoys accordingly reduces the stresses to which the mooring system 10 is subjected.

Figure 2:
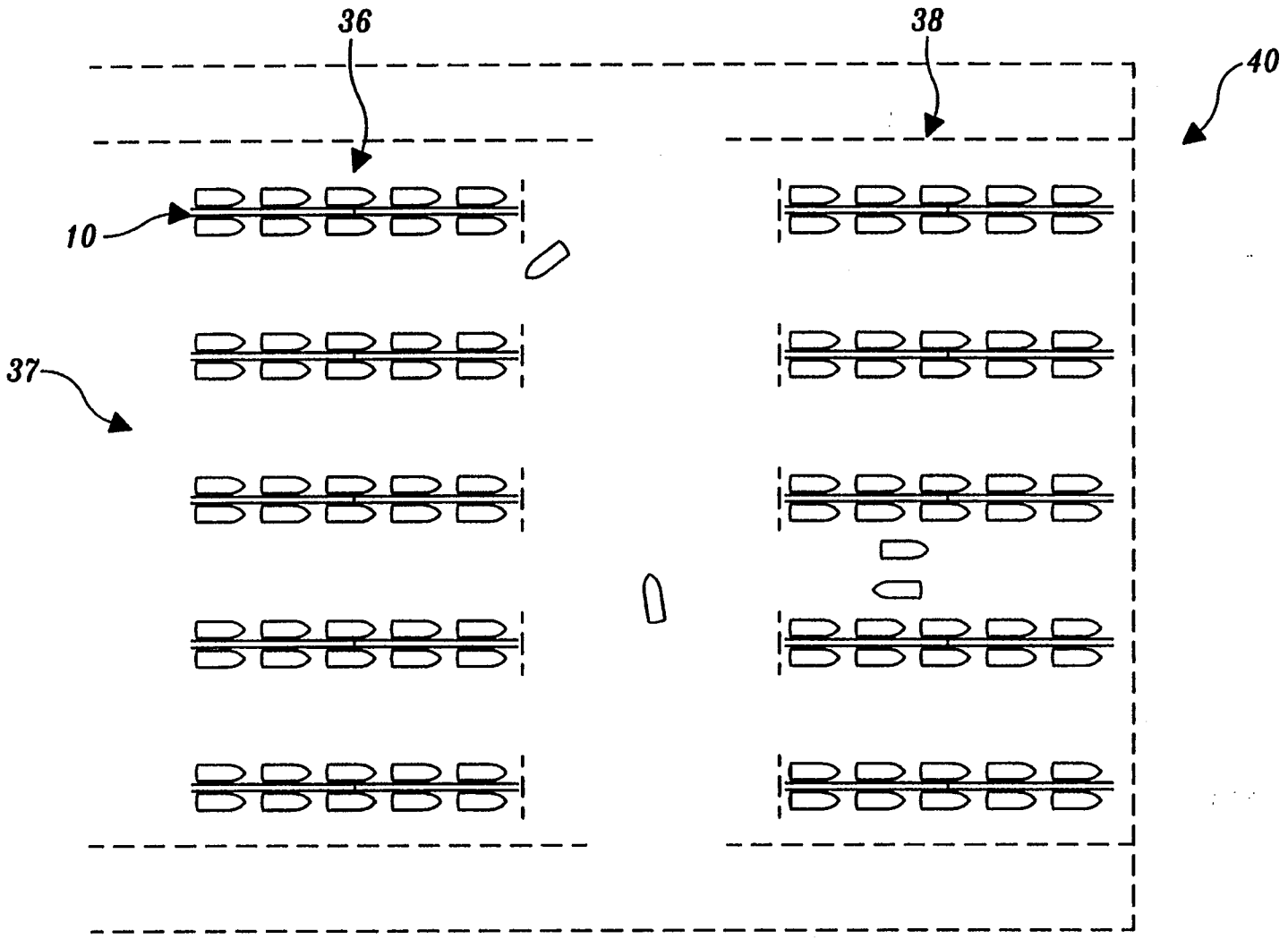
FIG. 2 illustrates one exemplary marina configuration that can be formed with the tautline boat mooring system provided by the present invention.

A series of the tautline mooring systems 10, i.e., segments, can be used to form a marina 37, as shown for example, in FIG. 2. In the illustrative marina 37 shown in FIG. 2, ten tautline boat mooring system segments 10 are arranged into two columns 36 and 38. As indicated by the dashed lines 40, a boundary line can be used to delineate the marina and define boat entry and exit paths. The boundary line 40 could be defined by a log boom, a string of floats, or using various other conventional prior art techniques and structures. Furthermore, additional segments of the tautline boat mooring system 10 could be used to define the marina perimeter by attaching visual markers, e.g., flags or surface floats, along the length of the tautline.

In addition to the particular configuration shown in FIG. 2, it will be readily appreciated that various other marina configurations can be formed using a number of tautline boat mooring system segments 10. Because a boat mooring system segment 10 can be repositioned by simply relocating the anchor assemblies 18, the marina 37 can be easily reconfigured. It will also be appreciated that while the boat mooring system segment 10 is shown to be linear, various other shapes, e.g., a C-shape, an L-shape, an E-shape, etc., can be formed, as explained in greater detail hereinafter.

Figure 3C:
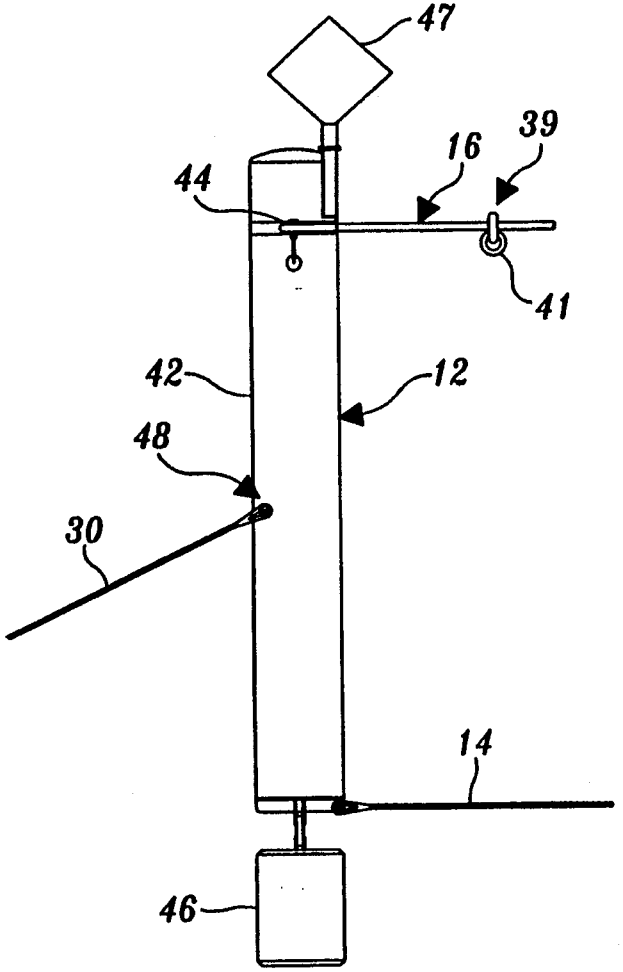
FIGS. 3A, 3B and 3C are respectively top, end and side views of an end spar buoy formed in accordance with the present invention.
Figure 3B:
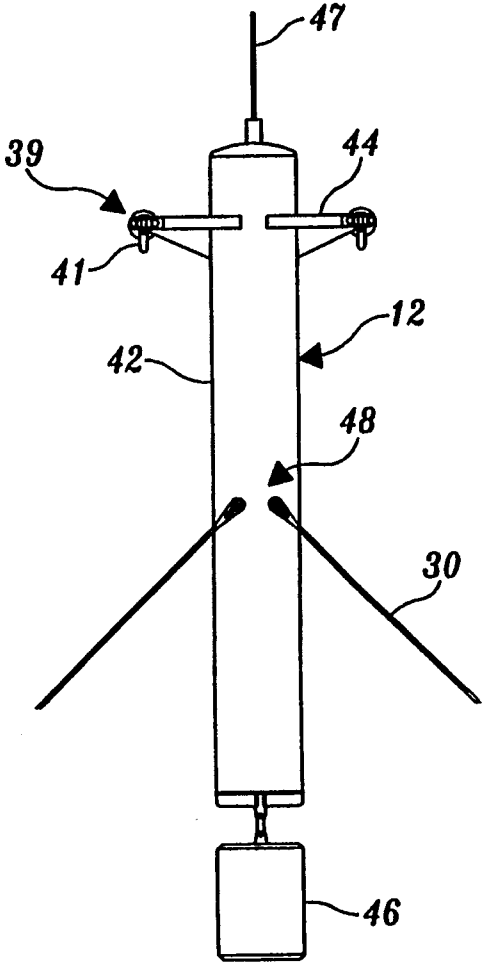
Figure 3A:
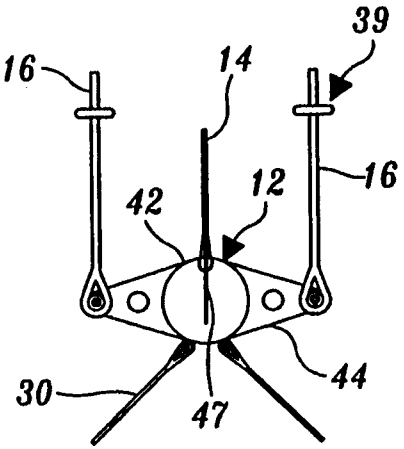

FIGS. 3A, 3B and 3C are respectively top, end and side views that illustrate the construction of an end spar buoy 12 in greater detail. In the preferred embodiment shown in FIGS. 3A–C, the end spar buoy 12 includes a cylindrical tube 42 that is capped at the top and bottom to provide a totally enclosed water-tight chamber, that is filled with air and buoyant since the mass of water that it displaces is equal to the mass of the cylindrical tube 42. A cross-tree 44 is formed near the top of the cylindrical tube 42, and the tautlines 16 are secured to opposite ends of the cross-tree 44 so that the tautlines 16 are held to the sides of the cylindrical tube 42, as seen in FIG. 3A. The gridline 14 is attached to the bottom of the cylindrical tube 42, as seen in FIG. 3C. The center of gravity of the spar buoy 12 is positioned below its center of buoyancy by appropriately weighting the spar buoy 12. In one preferred embodiment, the center of gravity is moved below the center of buoyancy by attaching a ballast 46 to the bottom of the cylindrical tube 42, as shown in FIGS. 3B and 3C. However, it will be readily appreciated that the spar buoys 12 can be weighted in various other fashions to achieve the desired spatial relationship between the center of buoyancy and the center of gravity. If desired, signage 47, as illustrated in FIG. 3C, can be attached on top of the cylindrical tube 42.

Tie-offs 39 as shown in FIG. 3C are preferably attached at several spaced-apart locations along the lengths of the tautlines 16. In this preferred embodiment, each tie-off 39 includes a ring 41 that forms an eye through which lines, i.e., ropes, can be passed. Any of the boats 20 are tied to the tautline 16 by securing one end of a line (not shown in this Figure) to the boat, passing the other end of the line through the ring 41 of the tie-off 39, and then securing that other end of the line to the boat.

Figure 5:
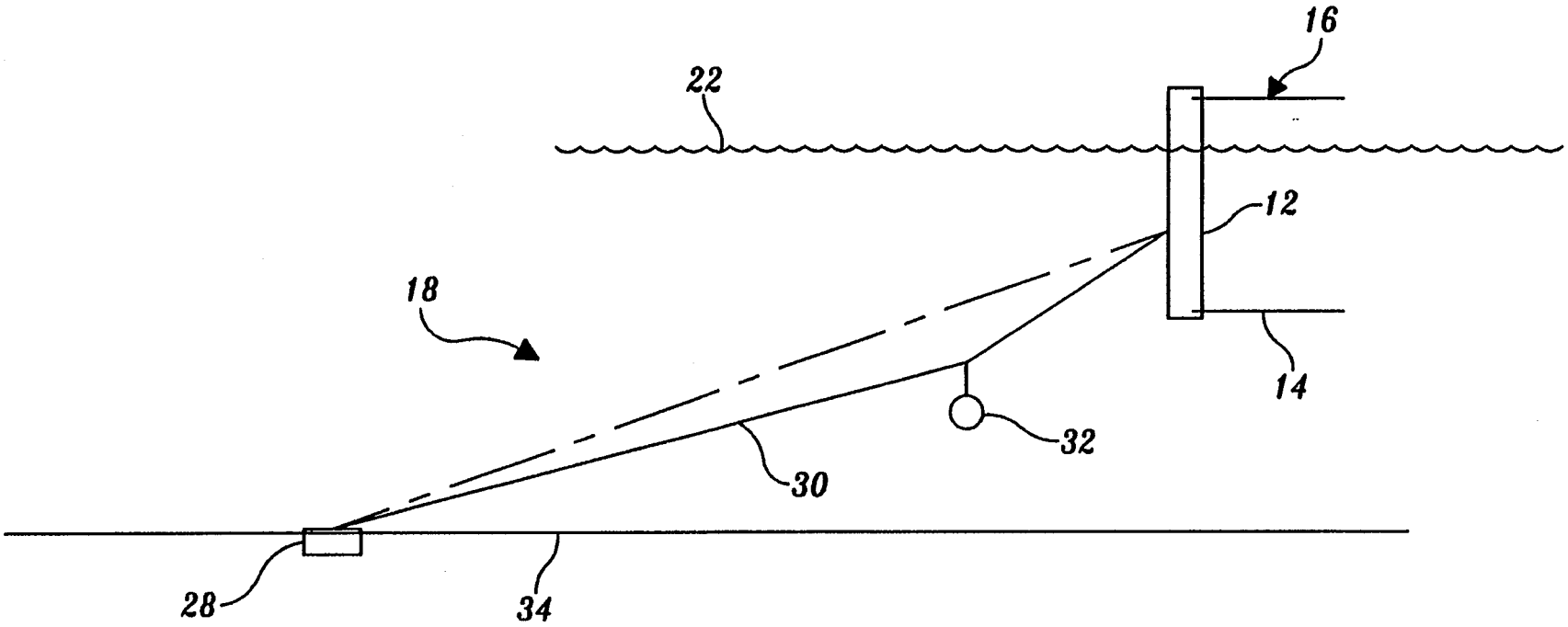
FIG. 5 is a side view of an end spar buoy when installed with one preferred form of an anchor assembly according to the present invention.

The anchor assemblies 18 maintain the tautlines 16 and gridline 14 in a taut state even when the level of the water surface 22 changes, e.g., due to tidal changes between the high tide level 24 and the low tide level 26. In the preferred embodiment shown in FIGS. 1A and 1B, each anchor assembly 18 includes an anchor 28, an anchor line 30 and a tom weight 32. The anchor 28 is secured to the bottom or sea bed 34 and the anchor line 30 is attached at one end to the anchor 28 and at the other end to one of the end spar buoys 12. The tom weight 32 is attached to the anchor line between the anchor 28 and the spar buoy 12 so that the tom weight 32 is suspended in the water above the sea bed. As shown in more detail in FIG. 5, the tom weight 32 exerts a downward vertical force on the anchor line 30 that keeps the anchor line under tension as the spar buoys 12 move vertically with tidal changes. In particular, by locating the anchor 28 a distance beyond the end spar buoy 12, the anchor assembly 18 exerts a backward force on the end spar buoy 12 that keeps the tautlines 16 and gridline 14 under tension.

In the preferred embodiment shown in FIGS. 1A and 1B, two anchor assemblies 18 are attached to each of the end spar buoys 12. As seen in FIG. 1B, the two anchor assemblies 18 attached to one of the end spar buoys 12 are located a distance beyond and spaced apart, on opposite sides of the end spar buoy 12 defining an included angle of about 25° to 50° that is generally centered relative to the gridline 14. This preferred placement of the anchor assemblies 18, in combination with the tension in the tautlines 16 and gridline 14, prevents the end spar buoy 12 from moving horizontally. Preferably, as shown in FIGS. 3B and 3C, the anchor lines 30 are attached to a middle section 48 of the cylindrical tube 42 of the end spar buoy 12 so that the backward force exerted on the cylindrical tube 42 is evenly distributed between the tautline 16 and the gridline 14. The backward force exerted on the end spar buoy 12 is preferably sufficiently great to keep the tautline 16 disposed above the water surface along its entire length. This backward force is achieved by appropriately choosing the volume and mass of the tom weights 32. To ensure that the tautlines 16 remain above the water surface, surface floats (not shown) could also be attached at intervals along the lengths of the tautlines 16. The surface floats would also improve visibility of the tautlines.

It will also be appreciated that tensioning assemblies other than tom weights 32 can be used to provide sufficient tension in the anchor lines 30. For example, in place of the tom weights 32, an auxiliary float (not shown) could be attached to the anchor line 30 so that it remains submerged in the water. The buoyancy of the auxiliary float would then create tension in the anchor line 30 by exerting an upward force on the anchor line. Furthermore, a tom weight 32 and an auxiliary float could be both attached to the anchor line 30 at different positions, e.g., by placing the tom weight 32 between the anchor 28 and the auxiliary float, so as to exert both upward and downward forces on the anchor line sufficient to keep the anchor line under the required tension. Furthermore, a helical spring assembly (not shown) of sufficient length and spring constant to maintain a relatively constant tension in the anchor line 30 could be attached between the anchor line 30 and the anchor 28.

Figure 4C:
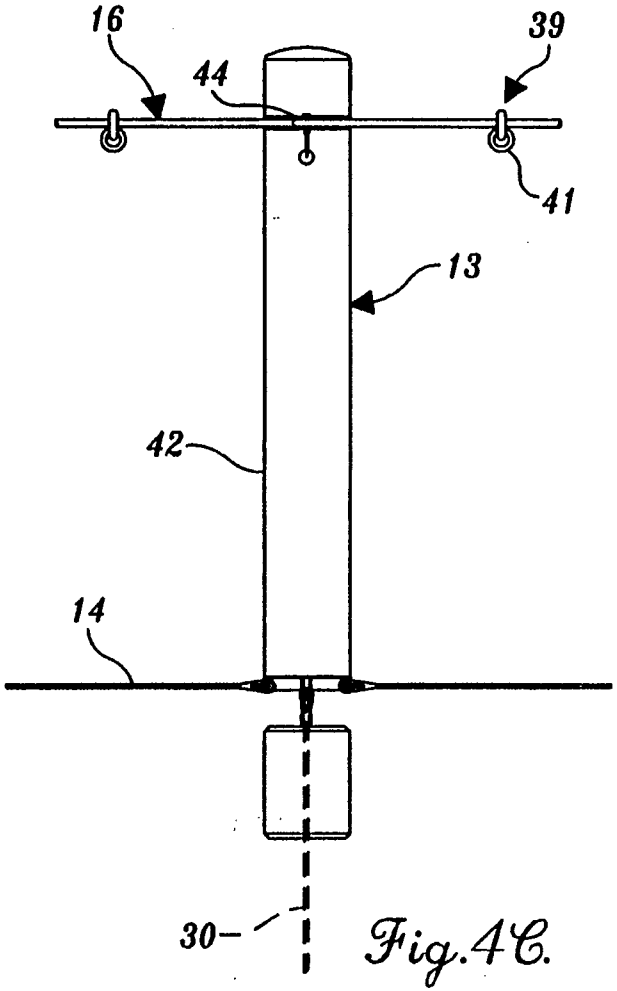
FIGS. 4A, 4B and 4C are respectively top, end and side views of an intermediate spar buoy formed in accordance with the present invention.
Figure 4B:
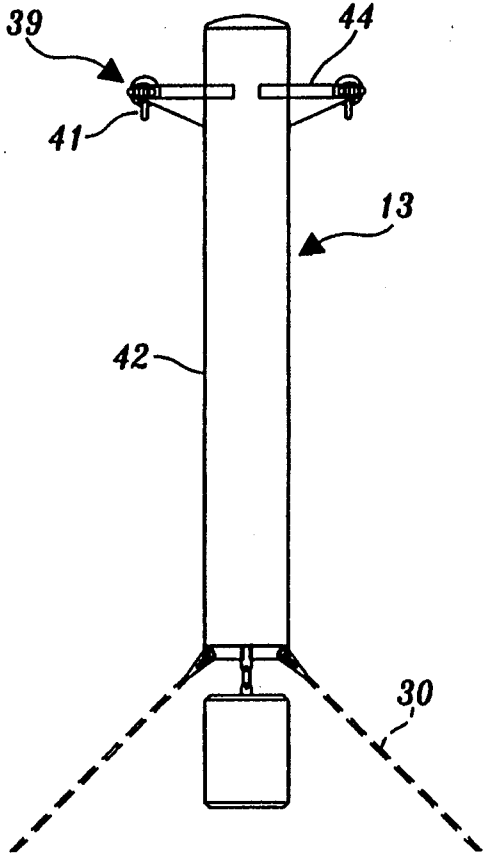
Figure 4A:
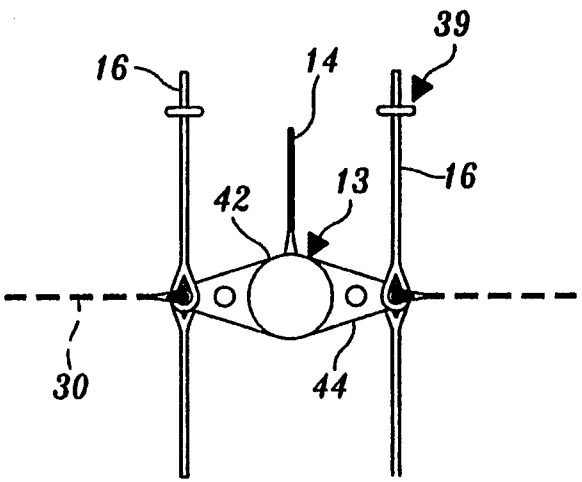

FIGS. 4A, 4B and 4C provide, respectively, top, end and side views of an intermediate spar buoy 13. The structure of the intermediate spar buoy 13 is similar in many ways to the end spar buoy 12 shown in FIGS. 3A–C and, accordingly, only the unique features of the intermediate spar buoy 13 will be described. As the intermediate spar buoy 13 is positioned between the end spar buoys 12, the tautlines 16 and the gridline 14 extend away from the intermediate spar buoy 13 in diametrically opposite directions. In one preferred embodiment, the gridline 14 and the tautlines 16 are formed in separate segments, as shown in FIGS. 4A and 4C, each segment interconnecting two spar buoys.

While an anchor assembly attached to the intermediate spar buoy 13 is not shown in FIG. 1A, it should be apparent that anchor assemblies 18 can be attached to the intermediate spar buoy 13 to prevent the intermediate spar buoys from moving laterally, i.e., transversely relative to the tautlines 16. The anchors 28 for these anchor assemblies would be located on opposite sides of the spar buoy 13, i.e., extending laterally away from the tautlines 16 and gridline 14. Preferably, as shown in FIG. 4B, the anchor lines 30 would be attached to the bottom of the cylindrical tube 42, at a depth sufficiently below the keel of boats using the tautline mooring system 10 so as to not interfere with the passage of those boats. One situation in which anchor assemblies 18 are preferably attached to intermediate spar buoys 13 is where the mooring system 10 is intended to be used with larger boats that subject the intermediate spar buoys to substantial lateral forces.

It is also contemplated that anchor assemblies 18 would be used with intermediate spar buoys if a non-linear configuration is desired for the tautline boat mooring system 10. For example, if a C-shape mooring system (not shown) is desired, several spar buoys 12, 13 would be interconnected with tautlines 16 and a gridline 14, and an appropriate number of anchor assemblies 18 would be attached to the spar buoys and positioned with the anchors 28 disposed radially outward of the curved loop to create the desired C-shape.

Commonly available materials can be used to form the various components of the tautline boat mooring system 10. Preferably, the lines, e.g., the tautlines 16, the gridline 14, and the anchor lines 30, are formed of braided plastic strands, of a type of plastic selected for its resistance to ultraviolet rays, temperature extremes and water exposure, such as polypropylene plastic. The tautlines 16 are preferably of a sufficiently large diameter so that they act like a bumper, i.e., exert little pressure on the sides of the moored boats 20 to prevent damage to the boats. Optionally, the tautlines could be padded. Instead of using a synthetic rope for the various lines, a metal chain or cable could be used. In one preferred embodiment, the spar buoys 12, 13 are formed of steel, however, plastic, as well as other materials, could be used. The ballast 46 attached to the bottom of the cylindrical tube 42 of the spar buoys 12, 13 is cast of concrete in one preferred embodiment, however, other materials, such as steel or lead, could also be used. Similarly, the anchors 28 and tom weights 32 can be formed of steel, lead, concrete, or other materials of sufficient density.

Figure 6B:
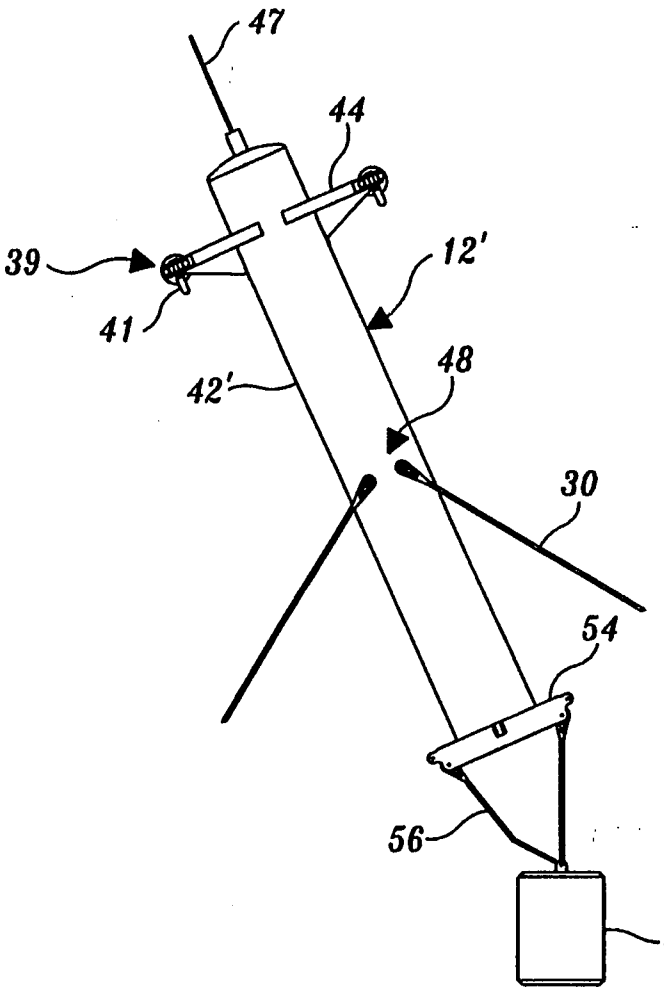
FIGS. 6A and 6B are end views of an alternative form of an end spar buoy according to the present invention.
Figure 6A:
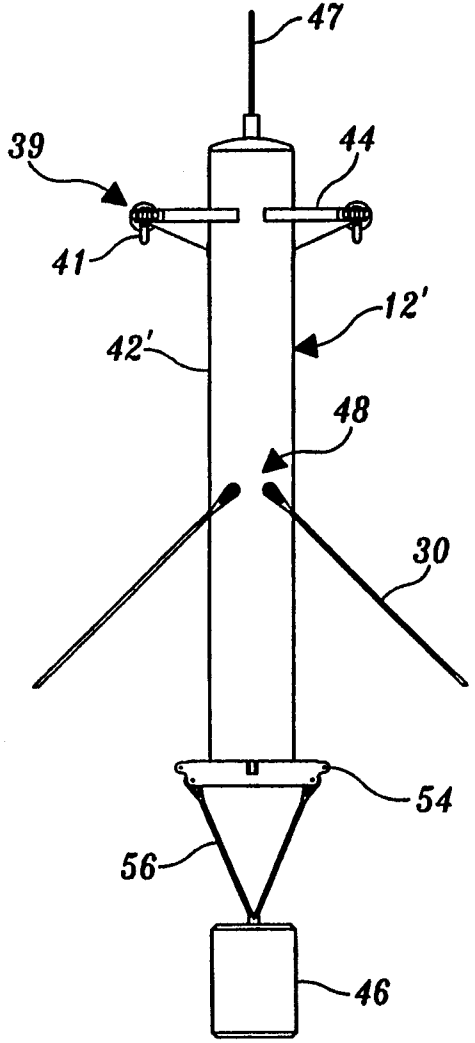

Various further changes can be made to the structure described up to this point. For example, as shown in FIGS.. 6A and 6B, the interconnection between the ballast 46 and the spar buoy can be modified so as to increase the stability of the spar buoy. FIGS. 6A and 6B show an end view of an alternative end spar buoy 12' that includes a bottom cross-tree 54, to which the ballast 46 is attached by lines 56. In particular, the cross-tree 54 is formed on the bottom of the spar buoy 12'. Two lines 56 are attached at one end to the ballast 46, and the other ends of the lines 56 are attached to opposite sides of the cross-tree 54. The advantage of connecting the ballast 46 in this manner is that the spar buoy 12' is more resistant to tilting. As illustrated in FIG. 6B, when the spar buoy 12' tilts from its normal vertical alignment, the majority of the weight of the ballast 46 is transferred to one of the lines 56 and the corresponding side of the cross-tree 54 so as to exert a righting moment on the spar buoy 12', tending to force the spar buoy back to its vertical alignment. More specifically, when the spar buoy 12' tilts, the weight of the ballast 46 is transferred to the side of the cross-tree 54 that rises as the spar buoy 12' tilts.

Figure 7:
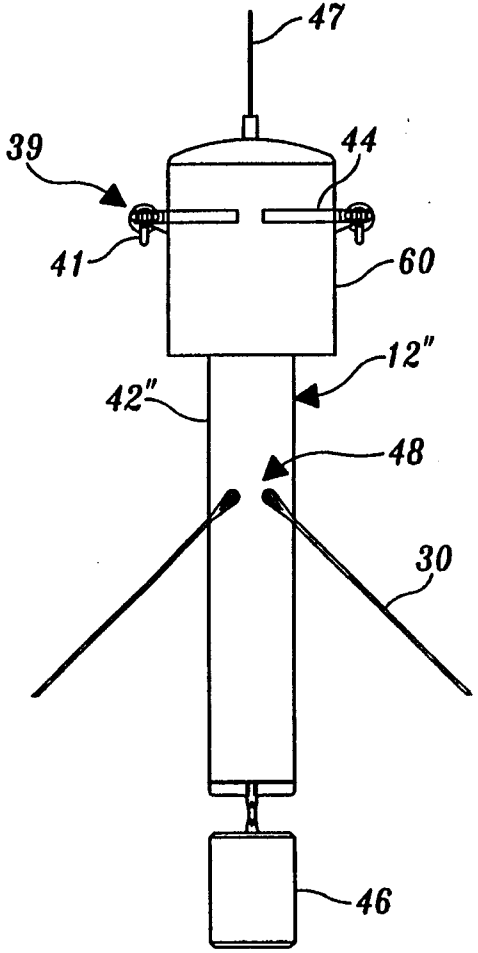
FIG. 7 is an end view of another alternative form of an end spar buoy according to the present invention.

FIG. 7 illustrates another alternative spar buoy design that increases the spar buoy's resistance to tilting. The end spar buoy 12" shown in the end view of FIG. 7 has a cylindrical tube 42" that has an upper section 60 that is wider in diameter than the rest of the cylindrical tube 42". By increasing the diameter of the upper section 60 of the cylindrical tube 42", the center of buoyancy of the spar buoy 12" is raised further above the center of gravity of the spar buoy 12". Increasing the distance between the center of buoyancy and the center of gravity in this manner increases the righting moment generated by the spaced-apart center of buoyancy and center of gravity when the spar buoy 12" tilts. Accordingly, the spar buoy 12" is more resistant to tilting.

As described hereinabove, the spar buoys are preferably elongated and of such a length that the bottom of each spar buoy is below the bottoms of the boats 20 with which the tautline boat mooring system is formed to be used. If the tautline boat mooring system is installed in shallow waters, it will be readily understood that the spar buoys will have to be shorter so as not to hit the sea bed. As the length of a spar buoy is decreased, the diameter of the spar buoy may have to be increased to provide sufficient buoyancy.

Figure 8:
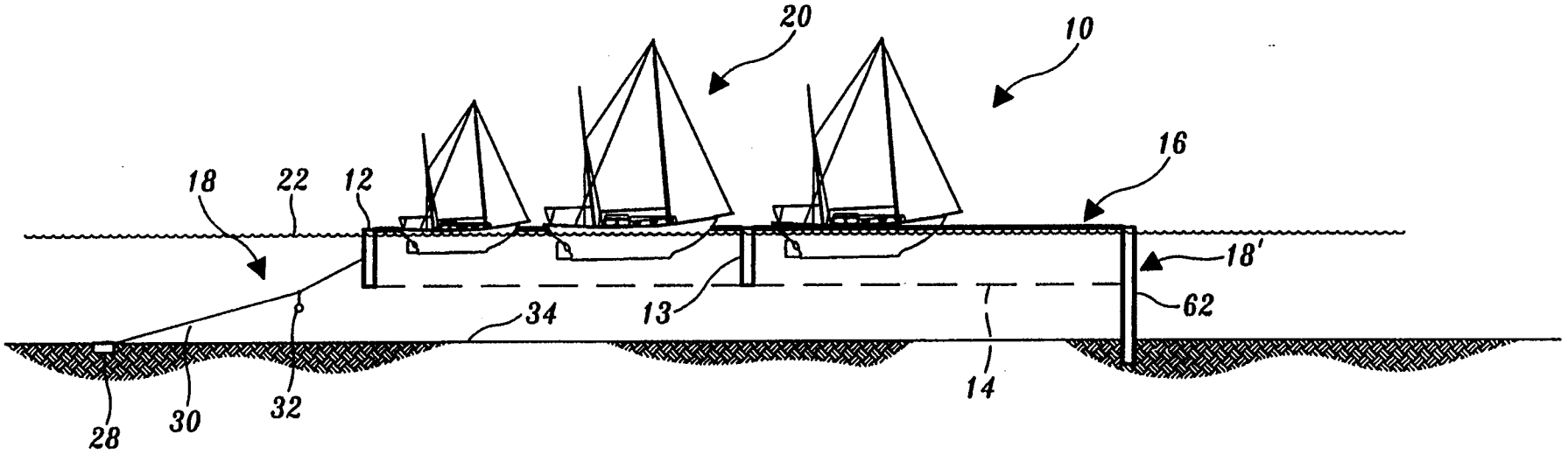
FIG. 8 is a side view of an alternative form of the tautline boat mooring system according to the present invention.

Another alternative design is illustrated in the side view of FIG. 8. FIG. 8 illustrates an alternative anchor assembly 18' for securing one end of the tautline boat mooring system 10. The alternative anchor assembly 18' shown in FIG. 8 simply comprises a piling that is driven vertically into the bottom or sea bed 34, with the top of the piling positioned above the water surface 22. Instead of attaching the ends of the tautline 16 and the gridline 14 to two end spar buoys 12, one end of each of the tautlines 16 and gridline 14 are attached to an end spar buoy 12, and the other end of each of the tautlines 16 and gridline 14 are attached to the piling 62 of the anchor assembly 18', instead of a second end spar buoy 12. This configuration is most practical in lakes where the water surface level does not change significantly. The anchor assembly 18' could be formed with various stationary structures other than the piling 62. For example, the tautlines 16 could be secured to shore and the gridline 14 could be secured to the bottom 34 near shore at a point where the depth of the bottom 3 is level with the bottom of the end spar buoy 12.

As will be readily appreciated from the foregoing discussion, the present invention provides a relatively high density boat mooring system that can accommodate boats of widely varying lengths, can withstand severe waves and current, is easily installed, reconfigured and removed, is not easily damaged by boats, and is relatively low cost. Furthermore, the tautline boat mooring system 10 is not unsightly because the only visible components of the mooring system are the tops of the spar buoys 12, 13 and the tautlines 16. The visibility of the mooring system can be further reduced during periods of nonuse, e.g., during the winter seasons, by removing the tautlines 16. With the tautlines 16 removed, the spar buoys would remain in place, held by the anchor assemblies 18 and the gridline 14. In addition to reducing the visibility of the mooring system, removing the tautline 16 allows boats to pass freely between the spar buoys. Furthermore, with the tautlines 16 removed, the mooring system would be better able to withstand freezing of the water surface because the spar buoys would be able to move more freely.

While the presently preferred embodiment of the invention has been illustrated and described, along with various alternatives thereto, it will be appreciated that further changes can be made thereto. Accordingly, the spirit and scope of the invention is not limited by the disclosure, but should instead be determined entirely by reference to the claims that follow.

The embodiments of the invention in which an exclusive property or privilege is claimed are defined as follows:

1. A boat mooring system comprising:

(a) first, second and third spar buoys, each adapted to float vertically and having an upper section and a lower section;

(b) a tautline extending substantially linearly and interconnecting said upper sections of said first, second and third spar buoys, said first spar buoy being secured to one end of said tautline, said second spar buoy being secured to the other end of said tautline, and said third spar buoy being secured to said tautline at an intermediate point between said first and second spar buoys;

(c) a gridline extending substantially linearly and securedly interconnecting said lower sections of said first, second and third spar buoys; and (d) a first anchor assembly and a second anchor assembly, said first anchor assembly being attached to said first spar buoy and said second anchor assembly being attached to said second spar buoy so as to urge said first and second spar buoys away from each other and maintain said tautline substantially linear and in a taut condition adjacent the surface of a body of water when said boat mooring system is installed in the body of water.

2. A method for providing a boat mooring system comprising the steps of:

(a) floating a plurality of spar buoys in a body of water, at spaced-apart locations defining a desired configuration, said configuration having opposite ends at which a first spar buoy and a second spar buoy are respectively disposed;

(b) interconnecting upper portions of said plurality of spar buoys with a first tautline and a second tautline, said first spar buoy being disposed at one end of each of said first and second tautlines and said second spar buoy being disposed at an opposite end of each of said first and second tautlines, said first and second tautlines being positioned on opposite sides of each of said plurality of spar buoys;

(c) interconnecting lower portions of said plurality of spar buoys with a gridline; and (d) anchoring at least said first and second spar buoys so as to:

(i) urge said first and second spar buoys away from each other;

(ii) maintain said first and second tautlines taut; and (iii) hold said plurality of spar buoys in a particular area in the body of water.

3. A method of mooring boats comprising the steps of:

(a) providing a tautline adjacent the surface of a body of water in which boats are to be moored;

(b) providing at least first and second spar buoys adapted to float vertically, upper sections of said at least first and second spar buoys being attached to said tautline at spaced-apart locations;

(c) providing a gridline attached to lower sections of said at least first and second spar buoys at spaced-apart locations;

(d) providing at least first and second anchor assemblies attached to said at least first and second spar buoys so as to urge said at least first and second spar buoys away from each other, maintaining said tautline taut, and holding said at least first and second spar buoys in a particular area in the body of water; and (e) securing a boat to said tautline, wherein said tautline has a plurality of tie-offs located at spaced-apart points along said tautline, and wherein said securing a boat to said tautline comprises securing a forward section of the boat to a first one of said tie-offs and securing an aft section of the boat to a second one of said tie-offs spaced apart from said first tie-off.

4. A boat mooring system comprising:

(a) a spar buoy adapted to float vertically and having an upper section and a lower section;

(b) a tautline having first and second ends, said first tautline end being connected to said upper section of said spar buoy;

(c) a gridline having first and second ends, said first gridline end being connected to said lower section of said spar buoy; and (d) a first anchor assembly and a second anchor assembly, said first anchor assembly being connected to said first spar buoy and said second anchor assembly being connected to said tautline second end and said gridline second end, so that said first and second anchor assemblies maintain said tautline substantially horizontal in a taut condition adjacent the surface of a body of water when said boat mooring system is installed in the body of water.

5. A boat mooring system comprising:

(a) a plurality of spar buoys, said plurality of spar buoys including a first spar buoy and a second spar buoy, each of said plurality of spar buoys being adapted to float vertically and having an upper section and a lower section;

(b) a tautline securedly interconnecting said upper sections of said plurality of spar buoys;

(c) a gridline securedly interconnecting said lower sections of said plurality of spar buoys; and (d) a first anchor assembly and a second anchor assembly, said first anchor assembly being attached to said first spar buoy and said second anchor assembly being attached to said second spar buoy so as to urge said first and second spar buoys away from each other and maintain said tautline in a taut condition adjacent the surface of a body of water when said boat mooring system is installed in the body of water.

6. The boat mooring system of claim 5, wherein said tautline extends substantially linearly between said first and said second spar buoys, which are disposed at opposite ends of said tautline.

7. The boat mooring system of claim 6, wherein said plurality of spar buoys include a third spar buoy disposed between said first and second spar buoys and interconnected therewith by said tautline and said gridline.

8. The boat mooring system of claim, 7, further including third and fourth anchor assemblies attached to generally opposite sides of said third spar buoy to prevent said third spar buoy from moving in a direction transverse to said tautline.

9. The boat mooring system of claim 8, wherein said third and fourth anchor assemblies each include an anchor line that is attached to the lower section of said third spar buoy.

10. The boat mooring system of claim 5, further including a second tautline adjacent and parallel to said tautline, said tautline and said second tautline being attached to opposite sides of each of said plurality of spar buoys, enabling a first boat to be moored to said tautline opposite a second boat that is moored to said second tautline.

11. The boat mooring system of claim 10, wherein said plurality of spar buoys each includes a cross-tree proximate said upper section for securing said tautline and said second tautline on the opposite sides of the spar buoy.

12. The boat mooring system of claim 11, further including a third anchor assembly attached to said first spar buoy, said first and third anchor assemblies extending generally toward opposite sides of said first spar buoy, so that said first and third anchor assemblies cooperate with said tautline and said gridline to resist a horizontal movement of said first spar buoy.

13. The boat mooring system of claim 5, further including a third anchor assembly attached to said first spar buoy, said first and third anchor assemblies extending generally toward opposite sides of said first spar buoy, so that said first and third anchor assemblies cooperate with said tautline and said gridline to resist a horizontal movement of said first spar buoy.

14. The boat mooring system of claim 13, wherein said first and third anchor assemblies comprise:

an anchor;

an anchor line attached to and extending between said anchor and said first spar buoy; and a tom weight attached to a middle section of said anchor line so that said tom weight is positioned above and off of the sea floor of the body of water, for maintaining tension in said anchor line.

15. The boat mooring system of claim 14, wherein said first spar buoy includes a middle section between said upper and lower sections of said first spar buoy, and wherein said anchor lines are attached to said middle section of said first spar buoy.

16. The boat mooring system of claim 5, further including a plurality of tie-offs attached at spaced-apart points along said tautline, said tie-offs being adapted to secure boats to said tautline.

17. The boat mooring system of claim 5, wherein each of said plurality of spar buoys includes a separate ballast attached to the lower section of the spar buoy.

18. The boat mooring system of claim 17, wherein the center of gravity of each of said plurality of spar buoys is below its center of buoyancy.

19. The boat mooring system of claim 17, further including two ballast lines attaching said ballast to opposite sides of the lower section of the spar buoy, so that when the spar buoy tilts, the weight of said ballast is transferred to the side of the lower section of the spar buoy that rises, so as to exert a righting moment on the spar buoy that tends to force the spar buoy back to a vertical alignment.

20. The boat mooring system of claim 5, wherein said upper section of each of said plurality of spar buoys has a larger cross-sectional area than said spar buoy lower section, so as to increase the resistance of each of said plurality of spar buoys to tilting.

21. A boat mooring system comprising at least:

(a) first, second, and third spar buoys that float vertically, each having a lower section and an upper section;

(b) a gridline extending substantially linearly and interconnecting said lower sections of said spar buoys at spaced-apart locations along said gridline;

(c) securing means extending substantially linearly and interconnecting said upper sections of said spar buoys at spaced-apart locations along the length of said securing means and adapted for securing a line connected to a boat; and (d) anchor means, attached to said spar buoys, for urging said spar buoys away from each other and maintaining said spar buoys in a substantially linear arrangement in a body of water.

22. The boat mooring system of claim 21, further including a plurality of tie-offs attached at spaced-apart points along said securing means, the line of the boat being attached to at least one of the plurality of tie-offs for securing the boat to said securing means.

* * * * *

UNITED STATES PATENT AND TRADEMARK OFFICE

CERTIFICATE OF CORRECTION

PATENT NO. : 5,398,633

DATED : March 21, 1995

INVENTOR(S) : G.F. Loverich et al.

It is certified that error appears in the above-indentified patent and that said Letters Patent is hereby corrected as shown below:

| COLUMN | LINE | |
|---|---|---|
| 1 | 59 | "omen" should read --often-- |

Signed and Sealed this

First Day of August, 1995

Bruce Lehman

*Attest:*

BRUCE LEHMAN

*Attesting Officer*

*Commissioner of Patents and Trademarks*